United States Patent [19]

Yang

[11] 4,456,150

[45] Jun. 26, 1984

[54] TUBE'S CAP AND THE PIERCE STRUCTURE OF A SEALED OPENING

[76] Inventor: Wei-Lu Yang, Taipei, Taiwan

[21] Appl. No.: 498,688

[22] Filed: Jun. 1, 1983

Related U.S. Application Data

[63] Continuation of Ser. No. 247,633, Mar. 25, 1981, abandoned.

[51] Int. Cl.[3] ..... B67B 7/26

[52] U.S. Cl. ..... 222/83; 222/153; 222/173

[58] Field of Search ..... 222/83, 83.5, 153, 91, 222/173, 81, 568; 215/252

[56] References Cited

U.S. PATENT DOCUMENTS 128,699 7/1872 Bostwick ..... 222/173

*Primary Examiner*—Charles A. Marmor

*Attorney, Agent, or Firm*—Tak Ki Sung

[57] ABSTRACT

A cap for use on a tube of adhesive is equipped with a cutter at one end for puncturing the sealed opening of the tube and an internal through bore, the cutter being maintained in a spaced relationship with the sealed opening prior to use by a protecting ring which can be readily deformed into a stand for the tube, the stand being attached to the cap when the cutter is moved to puncture the sealed opening.

1 Claim, 4 Drawing Figures

TUBE'S CAP AND THE PIERCE STRUCTURE OF A SEALED OPENING

This application is a continuation of application Ser. No. 247,633, filed Mar. 25, 1981, now abandoned.

The present invention relates to an improvement of a tube's cap of strong adhesive agent and of the pierce structure of its sealed opening. That is, equipped a knife inside of the cap and a protecting ring connected with several thin rods is fitted at the brim of the cap's bottom to separate the knife inside the cap from the sealed opening of tube. The thin rods connected with protecting ring are broken as the cap is forced to revolve around and the sealed opening of the tube is soon pierced by the knife provided inside the cap to allow dispensing of the strong adhesive agent.

Traditionally, the contained tube of a strong adhesive agent is always with its opening sealed. One must revolve the cap before use, and then pierce the opening with a needle or the like prior to pressing the tube to dispense the adhesive. It is inconvenient to so form the opening. Furthermore, the agent may stream out from the lateral tube during use, resulting in a messy situation.

The present invention provides a convenient cap which has a knife inside the cap and can pierce the opening of the tube only by revolving the cap.

The character of the present invention is to connect a protecting ring at the brim of the bottom of the cap whose inside is equipped with a knife. The cap does not pierce to form an opening before use. In use, one forces the cap to revolve to break down the connecting rods of the protecting ring to pierce the opening of the tube.

In the present invention, the cap, the protecting ring at the bottom of the brim of the cap and the knife inside the cap are all integrally formed. Among the connecting rods between the protecting ring and the cap, there is one thicker rod which is not broken as other rods are broken when one forces to revolve the cap and the protecting ring at the brim. The thicker rod is forced to stretch open and separate from the neck of the tube, but still connects with the brim of the cap. The protecting ring so stretched out is still connected to the cap and can be used as a washer of the tube to let the tube's cap incline upward when the tube is laid down to prevent the agent from streaming out during use. Because of the knife provided inside the cap of the present invention functions as a double-knife, when the user wishes to dispense the tube's agent, he/she only presses the cap and revolve 180 degrees, resulting in piercing out a circular opening.

The structure of present invention are described with attached drawing as follows.

Figure 1:
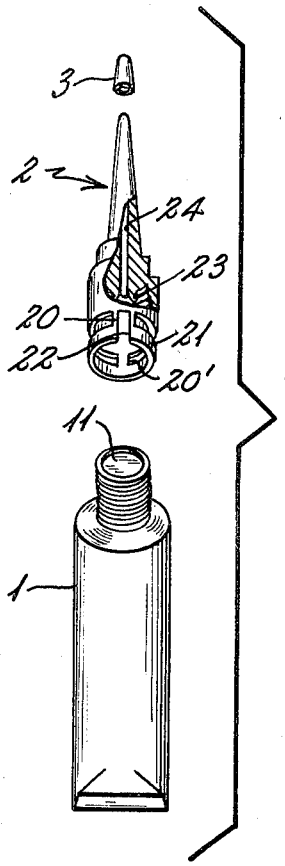
FIG. 1 shows the separated perspective view of the present invention.
Figure 2:
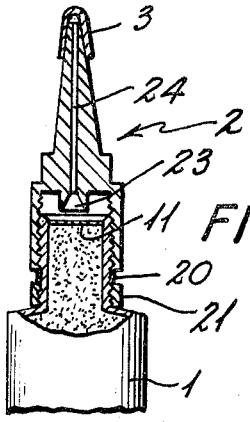
FIG. 2 shows the sectional view of the cap of the present invention.
Figure 3:
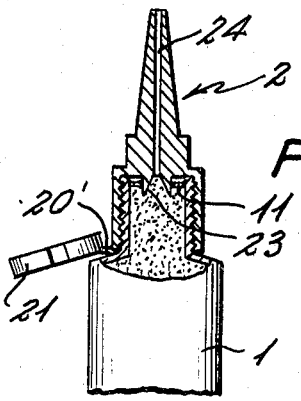
FIG. 3 shows the sectional view of the cap of the present invention wherein the protecting ring is forced out and is separated from the neck of the tube and the knife is pierced into the opening of the tube.
Figure 4:
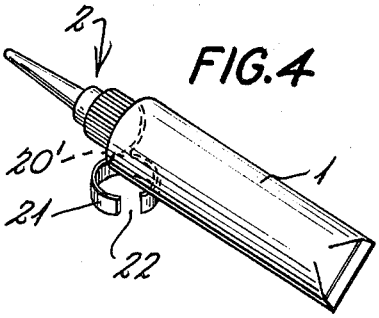
FIG. 4 shows the protecting ring which is used as a washer to keep the cap inclined upward when the tube is laid down.

In the drawings, (1) is a tube of strong adhesive agent, (2) is a tube's cap, (3) is a lid of cap. The cap (2) of the present invention has a protecting ring (21) connected at the brim of the bottom with several thin rods (20). The protecting ring (21) is provided with a gap (22) and inside the cap is knife (23) which functions as a double-knife. The cap (2), connecting thin rods (20), protecting ring (21) and the inside knife (23) are formed together, i.e. integrally formed. Among the connecting rods (20), there is one thicker rod (20) which keeps the protecting ring (21) connected to the brim at the bottom although the other rods have been forced to break. This cap can be rotated to set in the shoulder of tube (1) with the protecting ring (21) before use, because the inside knife (23) is separated from the opening of the tube or slightly connected, the user only needs to press the cap to break the connecting rods and rotate the cap. Because thick rod (20') does not break, the protecting ring (21) still connects with the brim at the bottom. As the cap (2) is rotated further, the other connecting rods break, and the protecting ring is forced to stretch open at the gap (22) and separate from the neck of the tube. Then the tube's opening is pierced by the knife (23) inside the cap (2). As the cap (2) is rotated, the knife (23) which pierces into the opening (11), cuts the whole sealed opening (11) circularly. After the sealed opening has been cut, the user can press the tube (1), and the strong adhesive agent will be squeezed out along the central hole (24) of the cap (2) for use. One can use the protecting ring (21) as a washer for tube (1) intermittently during use by letting the cap incline upward to prevent the strong adhesive agent from streaming out, when laying down the tube.

What is claimed is:

1. A dispensing cap for use on a tube of adhesive wherein said cap has a central hole for passage of adhesive, a piercing and cutting means in the form of a double knife depending from and substantially surrounding the inner end of said central hole, the inside surface of said cap being threaded to correspond with the threads provided on the exterior surface of the neck for said tube, a protecting ring maintaining said cap and associated piercing and cutting means in a spaced relationship with a sealed opening of said tube, and a protective cap for the outer end of said dispensing cap, said protecting ring being connected to said cap by frangible and non-frangible rods and being provided with a gap, said non-frangible rod having a thickness such that rotation of said cap to pierce and cut the sealed opening of said tube breaks said frangible rods and stretches said protecting ring forcing it away from the neck of said tube to a position where, by virtue of the non-frangible rod which connects said ring to said cap, it serves as a support to maintain said cap in an upwardly inclined attitude to avoid spillage of adhesive.

* * * * *